United States Patent [19]

Nishimori

[11] Patent Number: 4,697,746

[45] Date of Patent: Oct. 6, 1987

[54] GRINDER PUMP

[75] Inventor: Shinji Nishimori, Tokyo, Japan

[73] Assignee: Ebara Corporation, Tokyo, Japan

[21] Appl. No.: 765,941

[22] Filed: Aug. 15, 1985

[30] Foreign Application Priority Data

Aug. 17, 1984 [JP] Japan ..... 59-124684[U]

[51] Int. Cl.[4] ..... B02L 23/36

[52] U.S. Cl. ..... 241/46 B; 241/46.08; 241/46.11

[58] Field of Search ..... 241/46 R, 46 B, 46.02, 241/46.06, 46.08, 46.11, 46.17, 185 A

[56] References Cited

U.S. PATENT DOCUMENTS

| | | | |
|---|---|---|---|
| Re. 28,104 | 8/1974 | Grace . | |
| 2,370,590 | 2/1945 | Taylor . | |
| 2,464,936 | 3/1949 | McConaghy . | |
| 2,598,484 | 5/1952 | Adams . | |
| 2,682,376 | 6/1954 | Frank . | |
| 2,918,876 | 12/1959 | Howe . | |
| 3,128,051 | 4/1964 | Smith . | |
| 3,318,248 | 5/1967 | Rembold . | |
| 3,369,715 | 2/1969 | Carter . | |
| 3,417,929 | 12/1968 | Secrest . | |
| 3,556,677 | 1/1971 | Tremain . | |
| 3,650,481 | 5/1972 | Conery et al. | 241/46.11 |
| 3,726,486 | 4/1973 | Smith et al. | 241/46.11 |
| 3,738,581 | 6/1973 | Gallauresi et al. | 241/46.02 |
| 3,936,221 | 2/1976 | Lobanoff | 415/200 |
| 3,938,744 | 2/1976 | Allen | 241/46.11 |
| 3,961,758 | 6/1976 | Morgan . | |
| 3,973,866 | 2/1975 | Vaughan . | |
| 4,108,386 | 8/1978 | Conery et al. | 241/46.11 |
| 4,143,993 | 3/1979 | Blum . | |
| 4,454,993 | 6/1984 | Shibata et al. | 241/46 B |

FOREIGN PATENT DOCUMENTS

| | | |
|---|---|---|
| 25-58602 | 5/1950 | Japan . |
| 496504 | 4/1972 | Japan . |
| 51-45303 | 4/1976 | Japan . |
| 58-38396 | 3/1983 | Japan . |

OTHER PUBLICATIONS

"Hydr-O-Matic" bulletin 489.1.
"WG20" brochure, Section 520.

*Primary Examiner*—Timothy V. Eley
*Attorney, Agent, or Firm*—Oblon, Fisher, Spivak, McClelland, & Maier

[57] ABSTRACT

A release type grinder pump is disclosed which is capable of readily permitting the fitting and removal of a grinder ring with respect to a pump casing. The grinder pump includes an annular suction cover in which the grinder ring is fittedly held and which is detachably fitted in the pump casing so as to surround a suction port and allow the grinder ring not to have any portion directly held within the pump casing.

6 Claims, 1 Drawing Figure

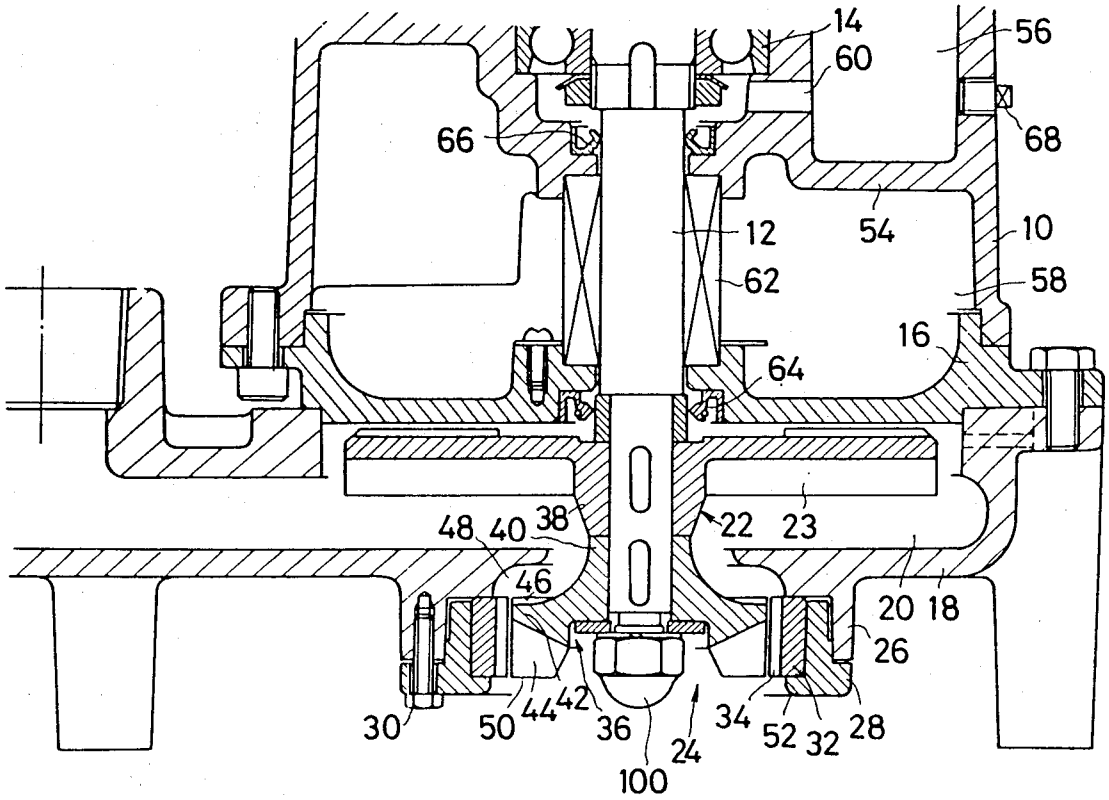
56
68
10
58
16
54
14
60
12
62
64
66
18
20
26
28
32
52
23
22
34
24
100
36
42
44
38
40
46
48
50
30

GRINDER PUMP

BACKGROUND OF THE INVENTION

1. Field of the Invention

This invention relates to a grinder pump, and more particularly to a grinder pump of the water immersed type which functions both as a pump and a grinder to pump liquid and concurrently grind or shred foreign material contained in the flowing liquid.

2. Description of the Related Art

A typical grinder pump which has been conventionally known in the art is disclosed in U.S. Pat. No. 4,454,993 issued to Tomoyuki Shibata et al on June 19, 1984 and assigned to the assignor of the application. The grinder pump is constructed in a manner such that a grinder ring is fitted in a pump casing and covered at the lower portion thereof by a suction cover, and the grinder ring, pump casing and suction cover are integrally held by bolts.

However, in the conventional grinder pump, because the grinder ring is rapidly worn due to the grinding or shredding of solid material contained in liquid to be pumped, it is required to frequently carry out the replacement of the grinder ring. Such replacement of the grinder ring is carried out by first removing the suction cover from the pump casing and removing the grinder ring from the pump casing. However, the removal of the grinder ring from the pump casing is highly troublesome and requires much time and labor, because the grinder ring is rigidly fixed in the pump casing.

Grinder pumps can be classified into two types. A first is the "resuction" type in which solid materials or woven fabric materials entrained in pumped liquid are repeatedly reciprocated vertically through a duct defined by the pump shroud into the grinder mechanism until they are completely passed upward or reduced in size and fall to an inaccessible area. An example of such a resuction type of grinder pump can be found in U.S. Pat. No. 3,667,692 (Reissue no. 28,104). In the Grace patent, solid materials are sucked up through an inlet duct to a comminutor or impeller disk. The solid materials or woven fabric materials are repeatedly reciprocated through the duct and onto the impeller disk until they are either completely passed upward or reduced in size and fall to an inaccessible portion of the bottom of the container within which the grinder pump is positioned. The shroud, together with the smooth internal surface of the comminutor ring constitute a duct which provides a guide for the smooth reciprocation of fluid and particulate matter therethrough. In the resuction type grinder, such as that of Grace, the need for a shroud thus provides an element which can be used for clamping a grinder ring into a pump casing.

However, there is a second type or "release" type of grinder pump which does not require a guide duct. Since the prolonged comminuting of solid or fabric material can cause fairly rapid wear of the comminutor blades, the release type of grinder pump provides a comminutor which serves more as a strainer than a comminutor. However, because of the lack of a shroud, it is difficult to provide clamping of the comminutor ring onto the pump body as is done in Grace.

Accordingly, it is desirable that a release type grinder pump be developed which is capable of readily carrying out the detachable fitting of a grinder ring with respect to a pump casing in order to facilitate the replacement of the grinder ring and the like.

SUMMARY OF THE INVENTION

The present invention has been made in view of the foregoing disadvantage of the prior art.

It is an object of the present invention to provide a grinder pump which is capable of readily permitting the fitting and removal of a grinder ring with respect to a pump casing.

It is a further object of the present invention to provide a grinder pump which is capable of allowing pump blades of a pump impeller to effectively carry out pumping operation over the whole length thereof.

It is still a further object of the present invention to provide a grinder pump which is capable of effectively protecting a bearing for supporting a pump shaft from leaked water and/or oil.

Still other objects and advantages of the present invention will in part be obvious and will in part be apparent from the specification.

The invention accordingly comprises the features of construction, combination of elements, and arrangement of parts which will be exemplified in the construction hereinafter set forth.

In accordance with the present invention, there is provided a grinder pump having a pump casing with a volute chamber defined in the pump casing, the volute chamber having a suction port. A pump shaft is provided to extend through the pump casing and a pump impeller is rotatably fitted on the pump shaft and arranged in the volute chamer. A grinder ring is provided around the suction port of the volute chamber. A grinder impeller is mounted on the pump shaft and is rotated by the pump shaft along the inner periphery of the grinder ring. An annular suction cover holds the grinder ring, the annular suction cover being detachably mounted in the pump casing in such a manner as to surround the suction port and allow the grinder ring not to have any portion directly attached to said pump casing, with a portion of the suction cover fitting between the annular wall of the pump casing and the grinder impeller.

In a preferred embodiment of the present invention, the grinder ring is mounted via the suction cover in the pump casing.

In a preferred embodiment of the present invention, the grinder ring is integrally fitted in the suction cover.

In a preferred embodiment of the present invention, the pump impeller has a plurality of radially extending pump blades and the grinder impeller has a boss which extends through the bottom wall of the pump casing to define a smooth annular passage therebetween whose sectional area gradually decreases toward the upper end of the grinder impeller.

In a preferred embodiment of the present invention, the grinder impeller is provided at the distal end thereof with a plurality of rotary blades, each of which has a lower edge formed so as not to project outward from the lower end of the grinder ring.

In a preferred embodiment of the present invention, the suction cover has a lower inner lip formed on the lower end thereof and projecting inward therefrom to support the grinder ring thereon. The grinder ring has a plurality of grinding edges formed on the inner periphery thereof. The lower inner lip of the suction cover is formed so as to terminate radially outward from the lower end of each of the grinding edges and be rounded toward the center of the suction cover. However it extends sufficiently inward to clamp the grinder ring.

In a preferred embodiment of the present invention, the pump casing is provided therein with a partition wall which divides the interior of the pump casing into an upper motor chamber and a lower shaft sealing chamber, the partition wall having a passage extending therethrough which is positioned below a bearing for supporting said pump shaft and communicates a chamber defined below the bearing with the motor chamber.

During operation, liquid and foreign materials flow generally parallel to the bottom surface of the grinder ring. This is permitted by the lack of a shroud such as that of Grace. Moreover, the termination of the lower inner lip of the suction cover at a position radially outward from the grinding edges of the grinder ring, together with the blades of the grinder impeller extending downward to the level of the bottom of the grinder ring permits liquid to flow upward between the grinder impeller and grinder ring and to be thrown radially outward by the rotation of the rotary blades of the impeller. The liquid and foreign materials strike against the inner surface of the grinder ring, after which a portion of the liquid flows upward together with the materials that have been comminuted by the grinder edges of the grinder ring and the rotary blades of the grinder impeller. Another flow portion flows downward and is freely rejected by the grinder. This portion contains foreign material which is too large to pass upward through the slots of the grinder ring. No guide duct is desirably provided to retain this foreign material for reciprocation. Instead, it is permitted to fall to the bottom of the tank and be removed by an appropriate suction device.

BRIEF DESCRIPTION OF THE DRAWINGS

For a fuller understanding of the invention, reference is had to the following description taken in connection with the accompanying drawings, in which:

FIG. 1 is a vertical sectional side view showing an embodiment of a grinder pump according to the present invention.

DETAILED DESCRIPTION OF THE PREFERRED EMBODIMENT

Now, a grinder pump according to the present invention will be described hereinafter with reference to the Figure.

Referring to FIG. 1 showing an embodiment of a grinder pump according to the present invention, a grinder pump of the illustrated embodiment includes a motor frame 10 and a pump shaft 12 which extends through the motor frame 10 and is rotatably supported by a bearing 14. The grinder pump also includes an intermediate casing 16 which is mounted on the end of the motor frame 10 and a pump casing 18 mounted on the intermediate casing 16 to define a volute chamber 20 between the intermediate casing 16 and the pump casing 18. In the volute chamber 20, a pump impeller 22 having a plurality of radially extending blades 23 is securely fitted on the pump shaft 12. The pump shaft is driven for rotation by a motor (not shown).

The volute chamber 20 has a suction port 24 formed at the outside of the pump casing 18 which is defined by a surrounding annular wall 26 of the pump casing 18, the wall 26 projecting outward from the pump casing 18. Reference numeral 28 designates a suction cover which is detachably fitted in the annular wall 26 by means of bolts 30 (only one shown). In the illustrated embodiment, a part of the suction cover 28 circumferentially contacts the inner periphery of the wall 26.

In the suction cover 28 is positioned a grinder ring 32 which has a plurality of grinding edges 34 formed on the inner periphery thereof, the grinding edges defined by a plurality of circumferentially spaced apart circular cutouts. The axis of the ring 32 extends in substantially the vertical direction and the ring 32 is fitted in a manner such that it is not attached directly to the pump casing 18 but is instead indirectly fitted to casing 18 via the suction cover 28. That is, the suction cover 28 fits between the grinder ring 32 and the annular wall 26 of the pump casing.

The grinder pump of the illustrated embodiment also includes a grinder impeller 36 which is mounted on the end of the pump shaft 12 and is held with its boss 40 contiguous to a hub 38 of the pump impeller 22 by the hexagonal nut 100, the lower end of which projects downward below the lower end of the grinder ring 32. The grinder impeller rotates with the shaft 12. Upon rotation of the grinder impeller 36, its periphery rotates along the inner periphery of the grinder ring 32. In the illustrated embodiment, the hub 42 of the pump impeller 22 is formed to be gradually decreased in diameter toward the lower end thereof.

The grinder impeller 36 is constructed to have a boss 40 positioned contiguous at the end thereof to the hub 38 of the pump impeller 22, a disc-like hub 42 formed integral with the boss 40 so as to extend outward therefrom and a pair of rotary cutter blades 44 extending from the lower end of the hub 42 and mutually spaced by 180°. The grinder impeller 36 also has auxiliary blades 46 provided on the other or upper side of the hub 15. In the illustrated embodiment, the boss 40 is formed integrally with the hub 42 so as to smoothly decrease in diameter from the hub 42 and abut against the hub 38 of the pump impeller 22 with the same diameter as the hub 38. Corresponding to the gradual decrease in diameter of the boss 40 of the grinder impeller 36, the pump casing 18 is gradually increased in diameter to form a smooth flow passage 48. Such construction allows fluid which is to be pumped to be smoothly introduced through the fluid passage 48 to the periphery of the hub section of the pump impeller 22 having a smaller diameter, so that the pump blades 23 may effectively carry out the pumping operation over the whole length thereof.

In the illustrated embodiment, the rotary blades 44 each have a lower edge 50 which is formed so as not to outwardly project from the lower end of the grinder ring 32. More particularly, the lower edge 50 of each rotary blade 44 is flush with or terminates above the lower end of the grinder ring 32. Also, the suction cover 28 has a lower inner annular lip 52 formed on the lower end thereof projecting inward therefrom to support or receive the grinder ring 32 thereon. The lower inner lip 52 of the suction cover 28 is preferably formed to terminate at a position radially outward from the lower end of each of the grinding edges 34 and is rounded toward the suction passage 24 but nonetheless clamps the grinder ring 32.

The motor frame 10 is provided therein with a partition wall 54 to divide the interior of the motor frame 10 into a motor chamber 56 and a shaft sealing chamber 58. A part of the partition wall 54 defining the motor chamber 56 is provided with a drainage passage 60 so as to communicate a space or chamber defined immediately below the bearing 14 with the motor chamber 56. The shaft sealing chamber 58 is adapted to provide sealing for the pump shaft 12 with the aid of a shaft sealing mechanism 62 such as a mechanical seal or the like.

Reference numerals 64 and 66 each designate a sealing member and 68 indicates a port divided in the motor frame 10 for permitting the discharge of oil and/or water collected in the motor chamber through the drainage passage 60, the supply of a lubricating medium, inspection and the like.

As can be seen from the foregoing, in the grinder pump of the illustrated embodiment, the grinder ring 32 is readily removed from the pump casing 18 by merely detaching the suction cover 28 from the pump casing. Also, the replacement of the grinder ring 32 is facilitated because it may be removed together with the suction cover 28 which is readily removed from the pump casing. Also, the drainage passage 60 for the bearing 14 is positioned below the bearing; thus, even when leakage of water and/or oil upward occurs from the volute chamber 20 through the sealing members 64 and 66 and the shaft sealing mechanism 62 toward the bearing 14, such water and/or oil is discharged through the drainage passage 60 to the motor chamber 56 without reaching the bearing. This effectively prevents any failure and damage of the bearing.

During operation, liquid and foreign materials generally flow parallel to the bottom surface of the grinder ring and in a radially inner direction until they reach the rounded surface of the lip 52. At this point, the pumped liquid flows generally upward and is contacted by the blades 44 of the grinder impeller 36 which throw the liquid and foreign materials generally radially outward until they strike against the inner surface of the grinder ring 32. Subsequently, a portion of the liquid flows upward together with materials that have been communicated by the grinder edges 34 of the grinder ring 32 and the rotary blades 44 of the grinder impeller 36. Another flow portion flows downward and is freely rejected by the grinder. This portion contains foreign material which is too large to pass upward through the slots of the grinder ring. No guide duct or shroud is provided to retain this foreign material for reciprocation. Instead, it is permitted to fall to the bottom of the tank and be removed by an appropriate suction device (not shown).

The termination of the lip 52 at a point radially outside of the bottom of the grinding surfaces 34 is important for the following reason. If the inner diameter of the lip were extended inward so as to be substantially equal to the inner diameter of the grinder ring 32, the cover ring would then form a bottom surface for the slots of the grinder ring 32. The flow which would otherwise be freely rejected downward, would instead by blocked by this bottom surface and be constrained to move either upward past the grinder ring or return radially inward to contact the rotating blades 44. Large solid or woven fabric materials, being unable to flow upward past the grinder ring due to their size, would thus be returned to the blades 44 for further comminuting. This mode of operation would convert the release type grinder pump to an operation analogous to that of the resuction type and would cause the excessive wear of the blades 44 which the release type grinder pump is intended to avoid.

Further, the auxiliary blades 46 effectively carry out a pumping function as well, to thereby substantially prevent string and the like from winding round the boss 40 of the grinder impeller 36 or the hub 38 of the pump impeller 22.

Furthermore, in the illustrated embodiment, the grinder ring 32 is formed to define, in cooperation with the pump casing 18, the annular fluid passage 48 therebetween, of which the sectional area is gradually decreased. Thus, fluid is smoothly introduced through the passage 48 to the pump impeller 22 to allow the pump blades 23 to carry out a satisfactory pumping operation over the whole length thereof.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A grinder pump comprising:

a pump casing;

a volute chamber defined in said pump casing, said volute chamber having a suction port;

a pump shaft extending through said pump casing;

a pump impeller fitted on said pump shaft for rotation therewith and positioned in said volute chamber;

a grinder ring having an outer radial periphery provided around said suction port of said volute chamber;

a grinder impeller mounted on said pump shaft for rotation therewith such that the periphery thereof rotates along the inner periphery of said grinder ring; and an annular suction cover in which said grinder ring is held, said annular suction cover being detachably mounted in said pump casing so as to surround said suction port, wherein said grinder ring is attached to said pump casing via said suction cover and is fitted and radially held within said suction cover with substantially no radial contact between said outer periphery of said grinder ring and said pump casing.

2. A grinder pump as defined in claim 1, wherein said pump impeller has a plurality of radially extending pump blades, and said grinder impeller extends through a bottom wall of said pump casing to define a smooth annular passage therebetween, the sectional area of said annular passage gradually decreasing toward the upper end of said grinder impeller.

3. A grinder pump as defined in claim 1, wherein said grinder impeller is provided at the lower end thereof with a plurality of rotary blades, said rotary blades each having a lower edge formed so as not to project outward from the lower end of said grinder ring.

4. A grinder pump as defined in claim 1, wherein said suction cover has a lower inner lip formed on the lower end thereof and projecting inward therefrom to support said grinder ring thereon; and said grinder ring has a plurality of grinding edges formed on the inner periphery thereof, said lower inner lip of said suction cover being formed so as to terminate at a position radially outward from a lower end of each of said grinding edges and being rounded toward the center of said suction cover.

5. A grinder pump as defined in claim 1, wherein said pump casing is provided therein with a partition wall which is arranged to divide the interior of said pump casing into an upper motor chamber and a lower shaft sealing chamber, said partition wall being formed with a passage which is positioned below a bearing for supporting said pump shaft, said passage communicating a chamber defined below said bearing with said motor chamber.

6. A grinder pump comprising:

a pump casing having an annular wall;

a volute chamber defined in said pump casing, said volute chamber having a suction port surrounded by said annular wall of said pump casing;

a pump shaft extending through said pump casing;

a pump impeller fitted on said pump shaft for rotation therewith and positioned in said volute chamber;

a grinder ring provided around said suction port of said volute chamber;

a grinder impeller mounted on said pump shaft for rotation therewith such that the periphery thereof rotates along the inner periphery of said grinder ring; and an annular suction cover in which said grinder ring is fittedly held, said suction cover being detachably mounted on said pump casing so as to surround said suction port and having a portion fittable between said annular wall and said grinder impeller.

* * * * *